United States Patent [19]

Rasada, Jr. et al.

[11] 4,257,492

[45] Mar. 24, 1981

[54] BUNK LADDER ANCHOR

[76] Inventors: Frank M. Rasada, Jr., 7912 LaRiviera Dr., Sacramento, Calif. 95826; John A. Starr, 1856 Cherry Ave., Long Beach, Calif. 90806

[21] Appl. No.: 40,747

[22] Filed: May 21, 1979

[51] Int. Cl.[3] ..... E06C 1/36; E06C 7/48

[52] U.S. Cl. ..... 182/206; 182/93

[58] Field of Search ..... 182/206, 150, 87, 93; 248/222.2, 224.2, 225.1, 223.4

[56] References Cited

U.S. PATENT DOCUMENTS

| | | | |
|---|---|---|---|
| 283,959 | 8/1883 | Bowyer et al. | 248/222.2 |
| 459,844 | 9/1891 | Thomas | 182/92 |
| 482,402 | 9/1892 | Booth | 182/206 |
| 3,071,350 | 1/1963 | Opie | 248/224.2 |
| 3,357,719 | 12/1967 | McCrea | 182/92 |
| 3,360,075 | 12/1967 | Gutner | 182/206 |
| 3,892,290 | 7/1975 | Lang | 182/206 |

*Primary Examiner*—Reinaldo P. Machado

*Attorney, Agent, or Firm*—Fulwider, Patton, Rieber, Lee & Utecht

[57] ABSTRACT

An anchor is provided for securing the upper extremity of a bunk ladder to an elevated support. A bracket is attached to the upper extremity of the ladder and has a configured hook extending downwardly and outwardly. A socket attached to the overhead support has an overhanging lip and a shoulder located therebeneath and spaced therefrom. The bracket hook is inserted between the lip and shoulder which together vertically immobilize the bracket and prevent withdrawal of the bracket hook therefrom when the foot of the ladder is in a supporting position.

6 Claims, 4 Drawing Figures

BUNK LADDER ANCHOR

BACKGROUND OF THE INVENTION

1. Field of the Invention

The present invention relates to ladder immobilizing devices for use with ladders which are repeatedly positioned and removed from specific locations.

2. Description of the Prior Art

There are a number of instances in which ladders are provided for dedicated use at a particular location but which are also removable therefrom. For example, bunk bed ladders are sometimes permanently installed in position, but frequently are removably positioned to allow an occupant to enter or leave an upper bunk or berth. Also, recreational vehicle ladders may be of the removable type and may be removably secured in position to allow ascension and decension to and from the exterior roof of the recreational vehicle. Boat ladders may be similarly employed to allow individuals to board and depart a boat or enter or leave a cabin located below deck.

In all of the foregoing ladder applications, the ladders are repeatedly mounted in essentially the same positions to allow access and egress to and from specific locations. To stabilize ladders at particular locations and to assure safety in climbing up and down a ladder, various systems have been devised for releasably attaching the upper extremity of the ladder to an overhead mounting location. In a typical conventional stabilizing device, a hooked portion of a bracket extends over a longitudinally extending bunk rail so that the upper extremity of the ladder can not be pulled rearwardly away from the bunk rail while an individual is climbing up or down the bunk ladder. However, conventional devices of this type typically require the hooked portion of the ladder attachment to pass to the inside of the bunk rail. Positioning in this manner frequently disturbs and snags and tears sheets and bedspreads which typically extend into the crevice between the bunk rail and the bunk mattress. Moreover, no horizontal restraints are provided to prevent the upper extremity of the ladder from sliding along the bunk rail. The absence of such a horizontal restraint contributes additionally to the liklihood that sheets and bed covers will become torn, but also presents a significant safety hazard to an individual traversing the ladder. Since bunk ladders are frequently used in association with beds for small children, the danger posed by the failure to provide a horizontal restraint is enhanced since the individuals ascending and descending the ladder have immature capabilities in their physical dexterity and ability to maintain balance.

A further disadvantage of conventional bunk ladder anchors which secure the upper extremity of the ladder to a bunk rail is that they are easily dislodged by forces applied to the bottom of the ladder unless an individual is ascending or descending the ladder. Very frequently minor forces applied, such as by the lateral movement of a suction head of a vacuum cleaner or by activity of individuals in the immediate areas causes the upper extremity of the ladder to dislodge from the bunk rail. The ladder is then likely to clatter downward. This is dangerous to individuals in the immediate vicinity, whom are likely to be struck by the falling ladder. A falling ladder is also likely to damage furniture and nearby objects which are broken and scarred when a ladder falls.

SUMMARY OF THE INVENTION

It is an object of the present invention to provide a ladder anchor for securing the upper extremity of a ladder in position against an elevated support by means of attachment wholly external to the support. The ladder anchor of the invention includes interacting hook and socket portions which can be releasably engaged and which interact in a face to face relationship. There is no necessity for any portion of the ladder attachment to contact longitudinal bunk rails. This reduces denting and scarring of the bunk rails which is very typical of conventional ladder attachments.

A further object of the invention is to provide a ladder anchor which is self-locking. The hook portion of the ladder attachment is mounted on a bracket and faces the elevated support. The hook curves downwardly and then turns transversely to terminate in an outwardly projecting extremity. The socket portion of the attachment on the other hand, includes an upper overhanging lip and a lower shoulder spaced therebeneath and extending outwardly beyond the lip to terminate in an upwardly directed extremity. When the feet of the ladder rails are raised slightly, the bracket hook can be inserted between the overhanging lip and the supporting shoulder. When the feet of the ladder are lowered, the overhanging lip forms an abutment to prevent vertical upward movement of the projecting extremity of the hook and hence the ladder itself. Concurrently, the shoulder engages the hook and extends vertically upward behind the projecting portion of the hook to prevent it from being laterally withdrawn from the socket.

The invention may be described with greater clarity and particularity by reference to the accompanying drawings.

DESCRIPTION OF THE EMBODIMENT

Figure 1:
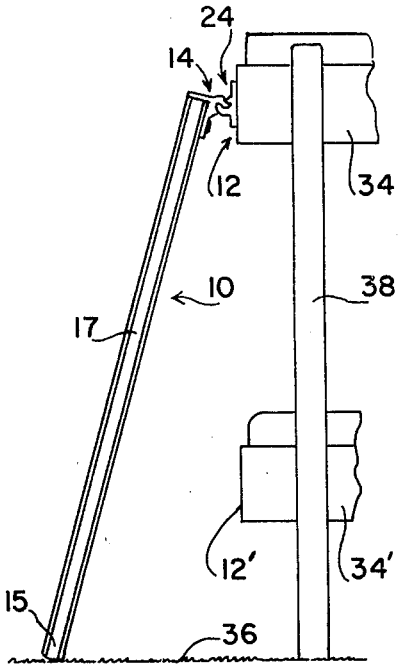
FIG. 1 is a side elevational view showing a ladder secured with an embodiment of the anchor of the invention.

FIG. 1 shows a bunk ladder 10 supported in position against an upper bunk rail 12 by means of the ladder attachment of the invention. The ladder attachment is depicted in detail in FIG. 2 and includes a bracket portion 14 having a channel shaped cap or base 16 with depending legs 18 that are secured to flanges at the upper extremity of the bunk ladder rail 17 by bolts 21. At the upper corner of the bracket 14 a curved hook 20 curves downward in a crook 19 and terminates in a nose 22 transverse to the crook and projecting laterally outward from the base 16. The bunk ladder anchor also includes a socket 24 constructed to receive the hook 20. The socket 24 has a flat mounting pad 25 and is attached in vertical disposition to the longitudinally extending bunk rail 12. The socket 24 includes a triangular shaped overhanging lip 26 and an arcuately upwardly curved shoulder 28 spaced therebeneath to define a gap with a lateral opening to receive the hook 20. The lip 26 and shoulder 28 immobilize the hook 20 from vertical movement and against withdrawal from the socket 24.

Figure 2:
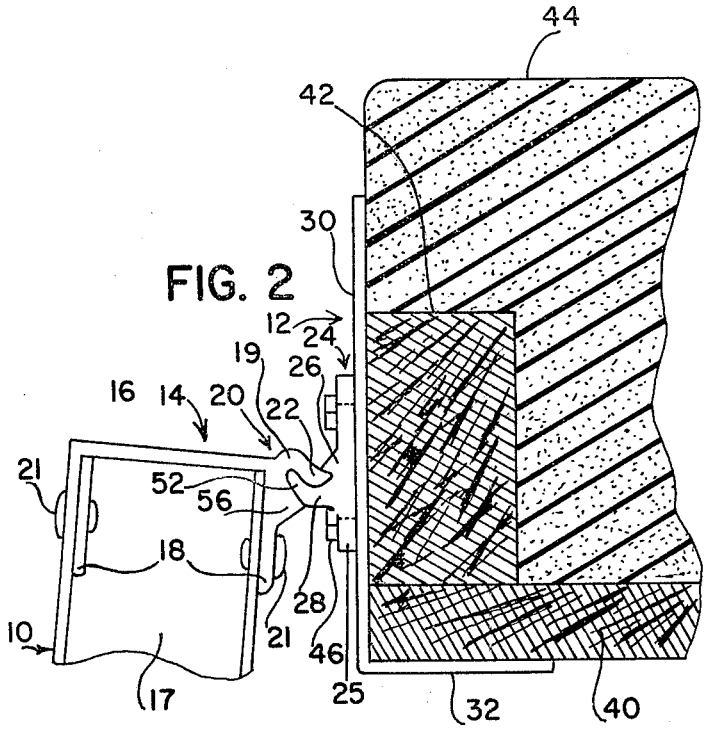
FIG. 2 is an enlarged side sectional view of the bunk ladder anchor of FIG. 1.

The ladder 10, depicted in FIG. 1, is a conventional ladder having a pair of upright rails 17 joined by horizontal rungs or steps. As illustrated in FIG. 2 the bunk rail 12 is of an L-shaped cross section and is formed as a longitudinally extending angle having a vertical upright side support 30 and a horizontally disposed lower support 32. The bunk rail 12 is secured in abutting relationship to a transverse headboard and footboard 34 which are supported above the surface of the carpeted floor 36, depicted in FIG. 1, by bed posts 38. The lower bunk bed depicted is of similar construction and includes a bunk rail 12' and a head board and a footboard 34'.

The horizontal lower support 32 of the bunk rail 12 supports a three quarter inch plywood mattress deck 40, as depicted in FIG. 2. A longitudinally extending rail backing board 42 provides longitudinal reinforcement for the bunk rail 12 and a backing for the vertical side support 30 thereof. A mattress 44, formed of foam as indicated in FIG. 2 or of other conventional construction is supported upon the mattress deck 40 and is confined within the boundaries formed by the bunk rails 12 and 12' and head and footboards 34 and 34' of the bunk beds depicted in FIG. 1.

The socket 24 is fastened to the bunk rail 12 by means of hex-head screws 46 that extend through the vertical mounting pad 25, through the vertical side support 30 and into the reinforcing backing board 42. A downwardly and outwardly sloping overhanging upper lip 26 extends from the mounting pad 25. The undersurface of the upper lip 26 is a flat horizontal surface, giving a triangular cross section to the upper lip. This flat horizontal surface forms an abutment to prohibit vertical upward movement of the outwardly extending tip of the hook 20. Spaced beneath the lip 26, and separated from it by a gap 50 is the outwardly extending shoulder 28, also projecting from the mounting pad 25. The shoulder 28 extends outwardly beyond the lip 26 and curves arcuately upwardly to terminate in an upwardly directed extremity 52, as depicted in FIGS. 2 and 3.

The hook 20 projects from the channel shaped bracket base 16. The curve of the crook 19 of the hook 20 arches upwardly and loops back down to define a concave recess therewithin configured to receive the upwardly turned extremity 52 of the shoulder 28. The nose 22 of the hook 20 projects outwardly transverse to the crook 19 and is received beneath the horizontal ledge formed by the underside of the upper lip 26 of the socket 24. A curved jaw 56 of the hook 20 is configured to conform to the underside of the shoulder 28 of the socket 24.

Figure 3:
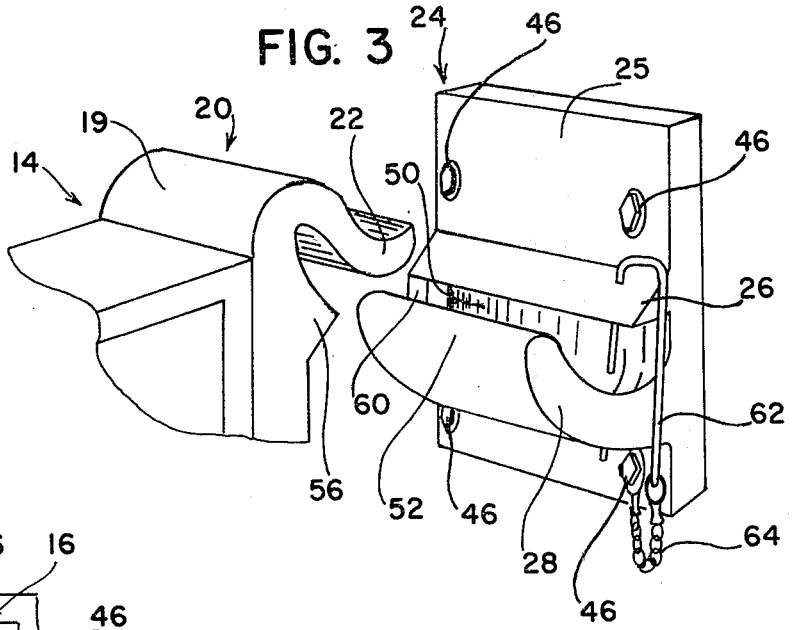
FIG. 3 is a perspective view showing the separate portions of the bunk ladder anchor.
Figure 4:
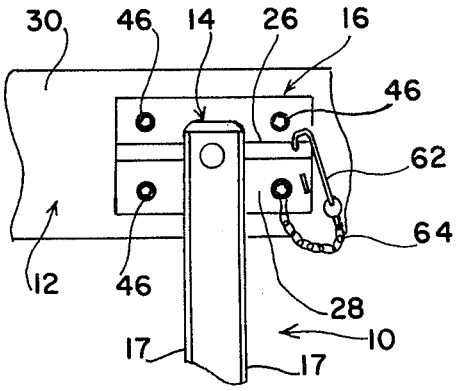
FIG. 4 is a rear view showing a rail of a bunk ladder secured in position with the anchor of the invention.

A side restraint to prevent longitudinal movement of the bracket 14 relative to the bunk rail 12 and the socket 24 is depicted in FIGS. 3 and 4. The side restraint includes a fixed lateral abutment 60 at the left hand extremity of the socket 24 to subject the bracket 14 to longitudinal immobilization in that direction. At the right hand extremity of the socket 24 a releasable locking pin 62 is coupled by a chain 64 to one of the hex-head bolts 46. The locking pin 62 is a steel U-shaped pin having one free leg and another leg attached to the chain 64. The free leg extends through vertically aligned apertures in the overhanging lip 26 and the shoulder 28 near the right hand edge of the socket 24. The free leg of the locking pin 62 may be inserted into the aligned apertures to prohibit longitudinal movement of the bracket 14 relative to the socket 24.

To position the bunk ladder 10 for use in the position indicated in FIG. 1, the ladder 10, carrying the hook 20, is initially laterally displaced to the right of the socket 24 from the position depicted in FIG. 3. The locking pin 62 is removed and the feet 15 of the ladder rails 17 are lifted slightly from the floor 36. The ladder 10 with the bracket 14 is then pushed to the left, as viewed in FIG. 3, so that the nose 22 of the hook 20 is entrapped between the overhanging lip 26 and the supporting shoulder 28 of the socket 24. By the same token, the shoulder 28 abuts the jaw 56 and nose 22 of the hook 20. When the hook 20 has been moved to the left into contact with the vertical abutment 60, it clears the vertically aligned apertures in the overhanging lip 26 and the shoulder 28 of the socket 24. The free leg of the locking pin 62 can then be inserted from above to entrap the hook 20 between the lip 26 and jaw 28 to thereby releasably immobilize the ladder 10. The feet 15 of the ladder rail 17 are then lowered to the floor and the ladder is available for use. The hook 20 is locked in the socket 24 and cannot be withdrawn therefrom or moved either vertically or horizontally when the feet 15 of the ladder 10 rest upon the floor 36.

As an alternative manner of engaging the bracket 14 with the socket 24, the feet 15 of the rail 17 of the ladder 10 can be rotated upward clockwise about 15 degrees from the position depicted in FIG. 1. The nose 22 is then able to pass between the lip 26 and the upwardly turned extremity 52 of the shoulder 28 into the gap 50 defined therebetween. Downward counterclockwise rotation carries the upper end of the nose 22 into abutment with the horizontal ledge defined at the underside of the overhanging lip 26 and seats the shoulder 28 between the hook 20 and jaw 56. Again, the hook 20 is immobilized and cannot be withdrawn from the socket 24 as long as the feet 15 of the ladder 10 remain upon the floor, provided the locking pin 62 is maintained in the releasable locking position indicated in FIGS. 3 and 4. The ladder 10 may be disengaged from the bunk rail 12 by removing the locking pin 62 and sliding the ladder 10 toward the right, as indicated in FIGS. 3 and 4 until the hook 20 clears the socket 24. Alternatively, the feet 15 of the ladder 10 can be rotated upward clockwise about 15 degrees, and the hook 20 can be withdrawn from the gap 50 and from the between the overhanging lip 26 and the upwardly projecting extremity 52 of the shoulder 28.

In either manner of utilization of the bunk ladder anchor of the invention, the hook 20 makes no contact with the interior surface of the bunk rail 12, and hence there is no possiblity sheets or bedspreads may be torn or rumpled. Nevertheless, the ladder 10 is firmly locked in position relative to the bunk rail 12 so that an individual can ascend and descend the ladder 10 without any danger of the upper extremity of the ladder slipping, either vertically or horizontally, relative to the upper bunk.

While the various features of the preferred embodiment of the invention have been illustrated, the specific implementation depicted should not be construed as limiting. For example, a vertical aperture could be defined through the nose 22 of the hook 20 in alignment with the vertically aligned apertures in the overhanging lip 26 and the shoulder 28. In such an embodiment, no vertically disposed abutments on the socket 24 are necessary, as the locking pin 62 would then pass through the overhanging lip 26, the nose of the hook 20, and the shoulder 28. Other modifications and alterations of the embodiment of the invention depicted are also possible. Accordingly, the scope of the invention should not be construed as limited to the specific embodiment depicted, but rather is defined in the claims appended hereto.

We claim:

1. A ladder attachment for removably securing the top of a ladder to an elevated support comprising:

a bracket having a base for mounting at the upper end of a ladder rail and having a hook with a crook disposed concave downward projecting from said base and a nose portion extending outwardly transverse to said crook, and a socket for attachment to said support and having an overhanging lip and a shoulder spaced therebeneath to define a gap with a lateral opening and a spaced abutment to receive said hook, whereby said lip and said shoulder immobilize said hook from vertical movement relative thereto and against withdrawal therefrom.

2. A ladder attachment according to claim 1 further characterized in that said socket is provided with immobilization means located beside said gap.

3. A ladder attachment according to claim 2 further characterized in that said immobilization means comprises a fixed abutment at one side of said gap at least partially obstructing said gap at one side of said socket, and a releasable locking pin insertable in aligned apertures defined in said lip and said shoulder proximate the opposite side of said socket.

4. A ladder attachment according to claim 3 further characterized in that said locking pin is attached to said socket by a flexible connector.

5. A ladder anchor for securing the upper extremity of a ladder to an elevated support comprising separable bracket and socket sections, one of which is attached to the upper extremity of said ladder facing said support, and the other of which is attached to said support facing said ladder and further characterized in that said bracket section is equipped with an outwardly directed and downwardly turned hook and said socket section includes an upper overhanging lip and a lower shoulder extending outwardly beyond said lip and terminating in an upwardly directed extremity, whereby said shoulder engages the underside of said hook and said upper lip defines an abutment to entrap the extremity of said hook.

6. A ladder anchor according to claim 5 further comprising horizontal immobilizing means to limit horizontal movement of said bracket relative to said socket.

* * * * *